US009903595B2

(12) United States Patent
Shingler et al.

(10) Patent No.: US 9,903,595 B2
(45) Date of Patent: Feb. 27, 2018

(54) NOISE REDUCTION IN COOKING SYSTEM

(71) Applicant: Evo, Inc., Beaverton, OR (US)

(72) Inventors: Robert A. Shingler, Beaverton, OR (US); Joseph R. Shaw, Beaverton, OR (US)

(73) Assignee: Evo, Inc., Beaverton, OR (US)

( * ) Notice: Subject to any disclaimer, the term of this patent is extended or adjusted under 35 U.S.C. 154(b) by 158 days.

(21) Appl. No.: 14/852,327

(22) Filed: Sep. 11, 2015

(65) Prior Publication Data

US 2017/0234548 A1 Aug. 17, 2017

(51) Int. Cl.
*F24C 15/20* (2006.01)
*F24F 9/00* (2006.01)
*F24F 7/06* (2006.01)

(52) U.S. Cl.
CPC ..... *F24C 15/2035* (2013.01); *F24C 15/2042* (2013.01); *F24F 7/06* (2013.01); *F24F 9/00* (2013.01)

(58) Field of Classification Search
CPC ..... F24C 15/20; F24C 7/06; A47J 37/06
USPC ..... 126/299 D, 99 A, 39 J, 110 R; 219/450.1
See application file for complete search history.

(56) References Cited

U.S. PATENT DOCUMENTS 613,516 A * 11/1898 James ..... E03F 5/042 137/247.19
4,024,839 A 5/1977 Reid, Jr. et al.
4,872,398 A 10/1989 Shen
5,952,625 A * 9/1999 Huff ..... F01N 1/06 181/265
5,983,888 A * 11/1999 Anselmino ..... F04D 29/664 126/299 D
6,837,152 B1 1/2005 Chiang
9,068,740 B2 * 6/2015 Takeda ..... F01K 3/24
2004/0194716 A1 * 10/2004 Morrison ..... A01K 5/0135 119/61.1
2009/0241939 A1 * 10/2009 Heap ..... F22B 1/006 126/645
2012/0247451 A1 10/2012 Chiang
2014/0048057 A1 * 2/2014 Bruckbauer ..... F24C 15/2035 126/299 D (Continued)

OTHER PUBLICATIONS

ISA Korean Intellectual Property Office, International Search Report and Written Opinion Issued in Application No. PCT/US2016/051082, dated Nov. 28, 2016, WIPO, 12 pages.

*Primary Examiner* — Gregory Huson
*Assistant Examiner* — Nikhil Mashruwala
(74) *Attorney, Agent, or Firm* — Alleman Hall Creasman & Tuttle LLP

(57) ABSTRACT

Examples are disclosed herein that relate to a ventilation system incorporated in a cooking apparatus. One example provides a cooking system including a body supporting a cooking surface, an air duct located within the body, and an air inlet disposed adjacent the cooking surface and in fluid communication with the air duct. The cooking system further comprises a fan disposed within the body and configured to pull exhaust from cooking through the air inlet and the air duct, a muffler configured to receive the exhaust from the fan, and an exhaust duct disposed within the body and connecting the fan to the muffler to carry the exhaust from the fan to the muffler, the exhaust duct having a curved configuration between an outlet of the fan and an inlet of the muffler.

12 Claims, 6 Drawing Sheets

(56) References Cited

U.S. PATENT DOCUMENTS

| | | | | |
|---|---|---|---|---|
| 2014/0075939 | A1* | 3/2014 | Aga | F01K 3/12 60/641.11 |
| 2014/0326145 | A1 | 11/2014 | McEvoy | |
| 2015/0192327 | A1* | 7/2015 | Marumoto | F24J 2/265 126/600 |
| 2016/0084508 | A1* | 3/2016 | McEvoy | A47J 37/0676 95/2 |

* cited by examiner

NOISE REDUCTION IN COOKING SYSTEM

BACKGROUND

Cooking may produce various volatile and particulate byproducts. Thus, an interior cooking installation may include a ventilation system for removing such byproducts. Many ventilation systems vent to an exterior of the cooking environment to avoid recirculating such byproducts into the cooking environment. Installing such ventilation systems may be quite expensive, as installation may involve structural modifications of a cooking facility. Additionally, ventilation systems also may produce significant noise, which may impact a dining experience where the ventilation system is located close to a dining area.

SUMMARY

Examples are disclosed herein that relate to cooking systems with internal ventilation systems. One example provides a cooking system including a body supporting a cooking surface, an air duct located within the body, and an air inlet disposed adjacent the cooking surface and in fluid communication with the air duct. The cooking system further comprises a fan disposed within the body and configured to pull exhaust from cooking through the air inlet and the air duct, a muffler configured to receive the exhaust from the fan, and an exhaust duct disposed within the body and connecting the fan to the muffler to carry the exhaust from the fan to the muffler, the exhaust duct having a curved configuration between an outlet of the fan and an inlet of the muffler.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Figure 1:
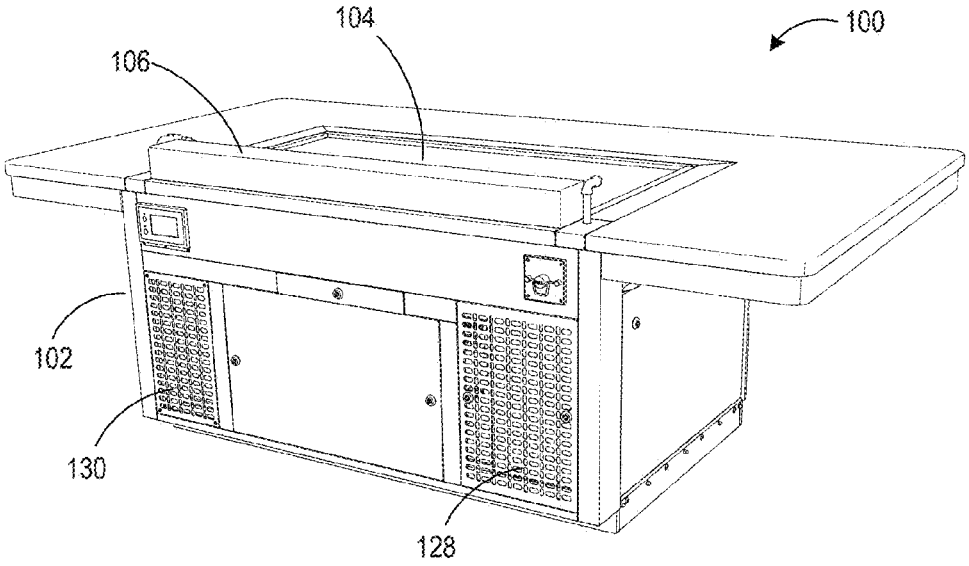
FIG. 1 shows an example cooking system.

In some indoor cooking settings, such as a restaurant, foods may be prepared in the presence of customers rather than in a separate kitchen. One example of such a setting is a teppanyaki-style restaurant, in which food preparation atop a large cooking surface is observed by customers sitting at a table surrounding the cooking surface. In such settings, a ventilation system hood is often positioned over the cooktop, and the ventilation system vents to the outside of the restaurant. Installing such systems may be expensive, and may involve modification of the roof and ceiling of the facility. Further, cleaning such ventilation systems may require accessing a roof of the facility.

Recently, indoor cooking grills have been developed with internally integrated ventilation systems that permit cooking exhaust to be cleaned, cooled and vented back into the cooking environment. Such internally ventilated grill systems may be installed without modifying the roof or ceiling of the cooking environment, and thus may provide significant cost savings to a cooking facility. Further, such ventilation systems may be conveniently accessed for cleaning. However, in such a system, the fan that pulls cooking exhaust away from the cooking surface is located within a body of the grill, rather than above a ceiling or on a roof of a facility. As a relatively high exhaust velocity may be employed to cool the exhaust sufficiently for internal venting, the fan and exhaust flow out of the grill both may produce noise.

Accordingly, examples are disclosed herein that relate to reducing ventilation system noise in an internally ventilated cooking system. Briefly, the examples provide for a cooking system having a curved exhaust duct connecting a fan to a muffler. The use of a curved exhaust duct between the fan outlet and the muffler inlet may allow a longer muffler to be used than if the path from the fan outlet into the muffler inlet were straight. Such a duct also may increase a path length of an exhaust path through the cooking system relative to the use of a straight path between the fan outlet and muffler inlet due to the combined length of the curved duct and longer muffler, and thereby may help to cool exhaust to a greater extent than an exhaust path without the curved duct and with a smaller muffler. Additionally, the disclosed examples may include a noise reduction screen on the body of a cooking system to reduce impingement noise arising from muffler exhaust of another cooking system arranged in a back-to-back manner, as found in some teppanyaki restaurants.

A cooking system may have other sources of noise than exhaust noise. For example, the cooking system may include a filtration assembly between the air duct and the fan, and a tapered channel structure (e.g. a cone-shaped flange connector) connecting the filtration assembly to the fan. Depending upon the construction of the tapered channel structure and the fan, low frequency resonances may form that are audible within the cooking environment. As such, the tapered channel structure may be configured to avoid such resonances, thereby helping to further reduce noise.

Figure 2:
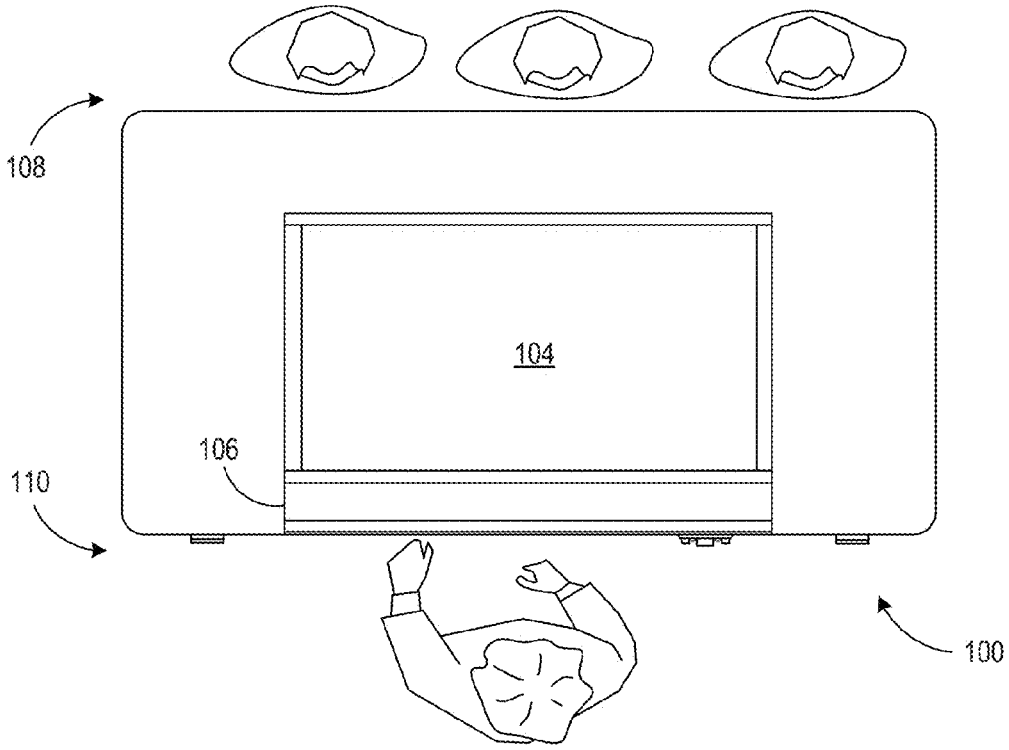
FIG. 2 shows a top view of the cooking system.

FIG. 1 shows a rear perspective view of an example cooking system 100. The cooking system 100 includes a body 102 supporting a cooking surface 104, and an air inlet 106 disposed adjacent to the cooking surface 104. FIG. 2 shows a top plan view of the cooking system 100. The body includes a front side 108 by which customers may sit, and a backside 110 of the body 102 by which a chef may stand when preparing food. The cooking system 100 also includes a noise reduction screen 128 positioned on the backside 110 of the body 102 at a location laterally spaced from an outlet 130 of the muffler 122.

Figure 3:
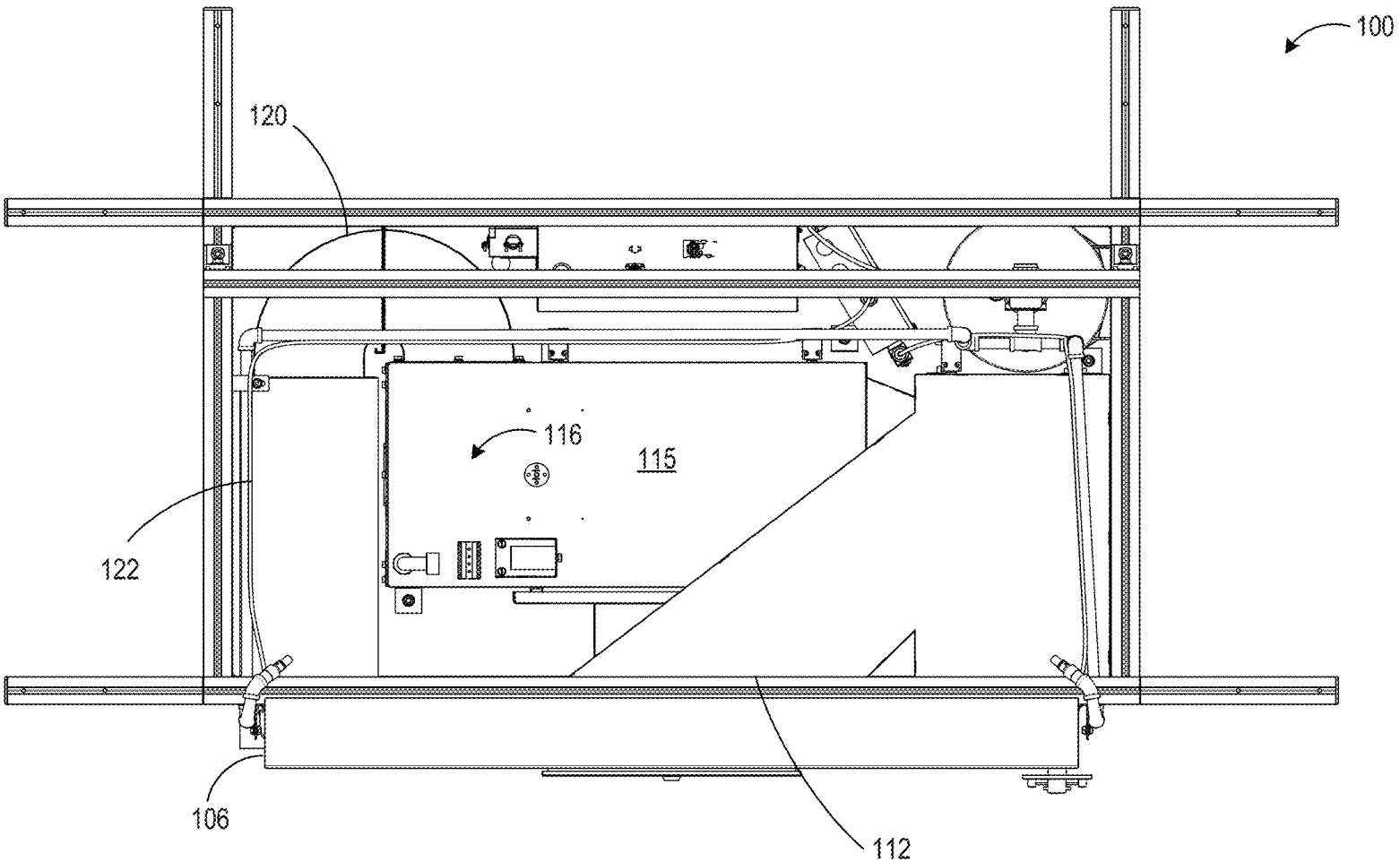
FIG. 3 shows a top view of the cooking system with a cooking surface removed.
Figure 4:
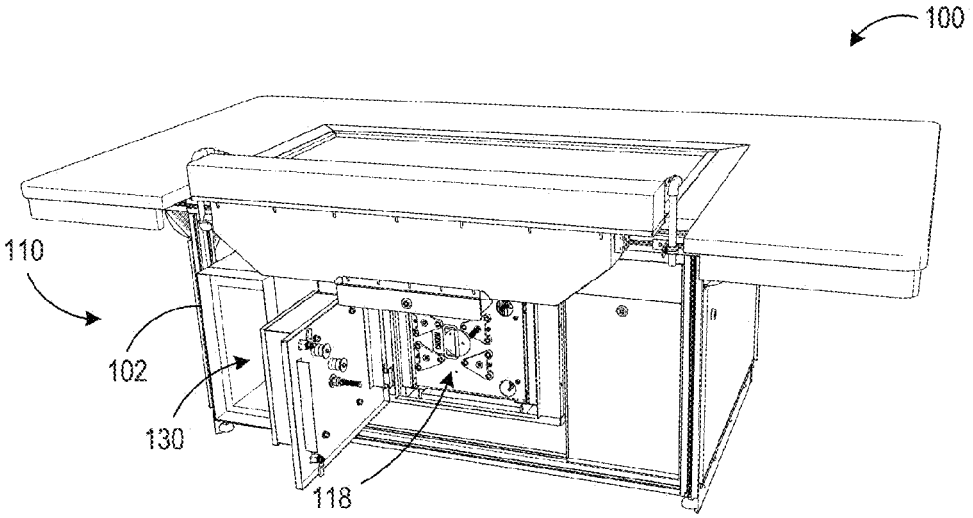
FIG. 4 shows the cooking system having a back portion removed.

FIGS. 3 and 4 respectively show top and back perspective views of the cooking system 100 of FIG. 2 with some external surfaces removed to illustrate internal components. The body 102 encloses an air duct 112 in fluid communication with the air inlet 106 to receive exhaust pulled through the air inlet 106. Further, an internal housing 115 that contains a fan 116 and electrostatic precipitator system 118 is disposed within the body 102. FIG. 3 also shows a curved exhaust duct 120 connecting an outlet of the fan 116 to an inlet of a muffler 122.

In some examples, the fan 116 may take the form of a blower wheel fan (e.g. a squirrel cage fan) that draws air in along an axial direction relative to the blower motion, and exhausts the air in a direction tangential to the blower wheel motion. In the arrangement of FIG. 4, if the outlet of the fan 116 were directed toward the backside 110 of the body 102, it would be difficult to include a muffler between the fan outlet and the cooking system exhaust outlet 130 back of the body without the muffler extending a potentially significant distance out of the body.

Figure 5:
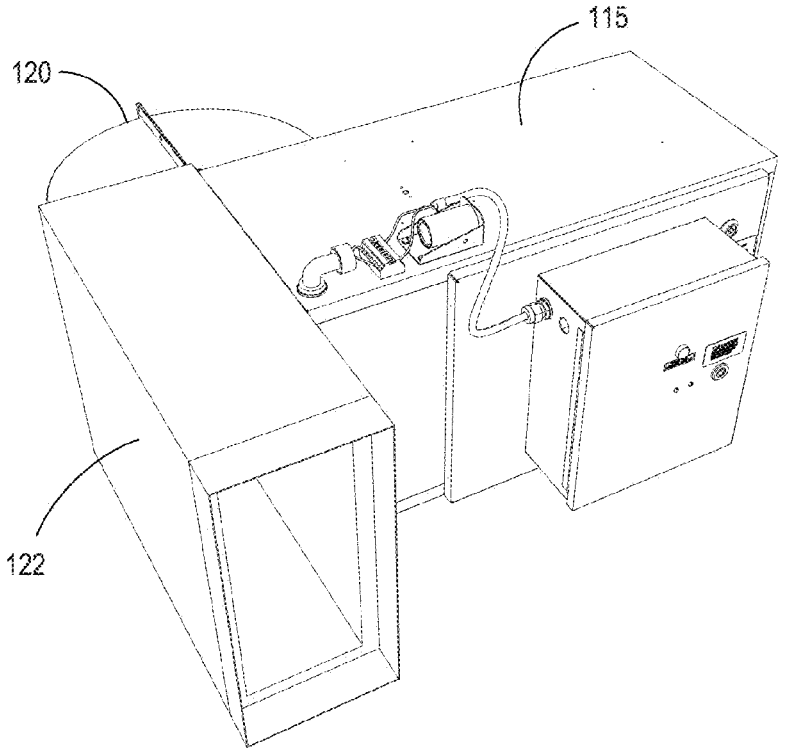
FIG. 5 shows example components of a ventilation system.
Figure 6:
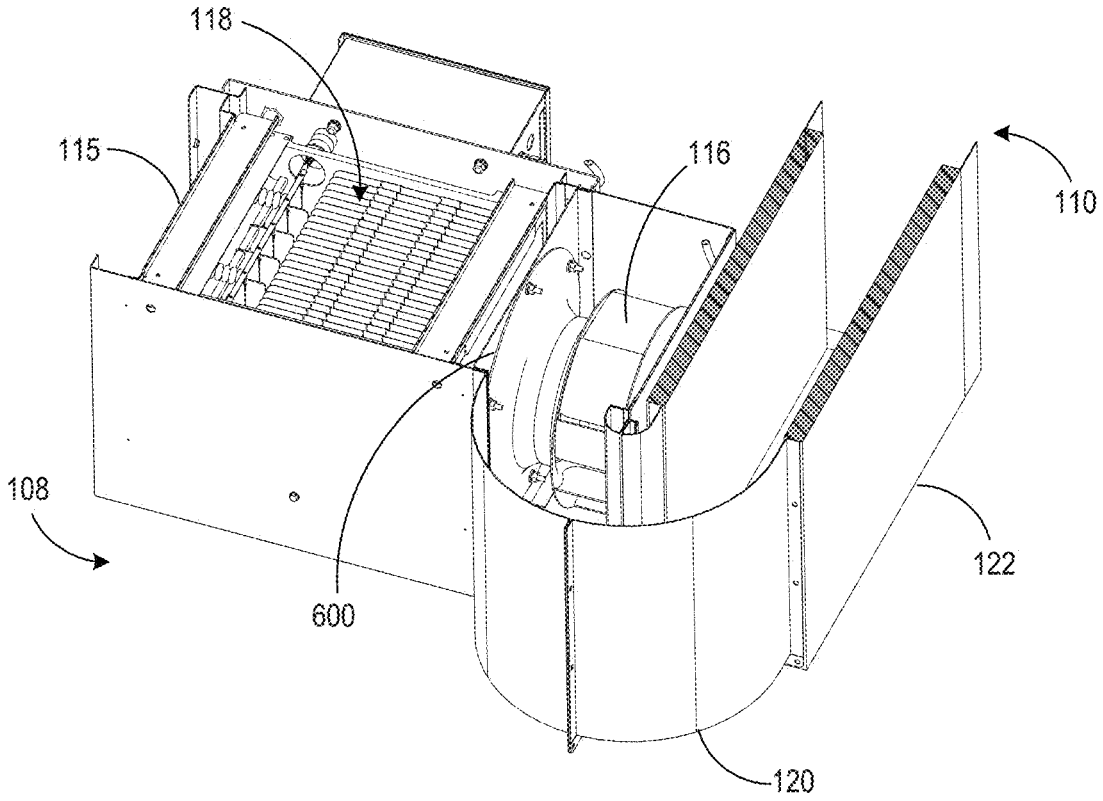
FIG. 6 shows another view of the example components of FIG. 5 with some surfaces removed.

Thus, the outlet of the fan 116 of the cooking system 102 is oriented toward a front side 108 of the cooking system 102, and a curved exhaust duct redirects the air into a muffler. FIG. 5 is a rear perspective view of an example curved duct 120 and muffler 122 configured to receive exhaust from a fan housed in an internal housing 115. FIG. 6 is a front perspective view of these structures with a portion of the internal housing 115 removed to illustrate the fan 116 and electrostatic precipitator 118. Exhaust from the air duct 112 may pass through a first filtration stage (not shown), and then into the electrostatic precipitator 118. The electrostatic precipitator system 118 may include various filters in addition to the electrostatic precipitator, such as inlet and exit filters disposed respectively upstream and downstream of the electrostatic precipitator. The electrostatic precipitator 118 is connected to an inlet of the fan 116 via a tapered channel structure 600, as mentioned above.

In the depicted example, the fan exhaust is oriented toward the front side 108 of the cooking system 100. Exhaust from the fan 116 is directed into the curved exhaust duct 120, which redirects the exhaust into the muffler 122. As can be seen, the use of the curved exhaust duct 120 allows a longer muffler to be incorporated within the body 102 of the cooking system 100 than if the fan outlet were directed toward the backside 110 of the cooking system 100. In the depicted examples, the exhaust duct 120 includes a 180-degree turn between the outlet of the fan 116 and the inlet of the muffler 112. In this configuration, the turn of an exhaust duct may have any suitable angular magnitude, such as between 160-200 degrees, or between 170-190 degrees. A duct having a turn in this range may redirect a flow of fan exhaust from a direction toward a front of a cooking system to a direction toward a back of a cooking system. In other examples, a duct may have any other suitable curvature, depending upon a direction in which a fan directs exhaust and a side of a cooking system from which the exhaust is to be vented after passing through a muffler.

The cooking system 100 may further include a sound-dampening material disposed on one or more surfaces within the body of the cooking system. For example, sound-dampening material may be placed on the filtration assembly 118, air duct 112, exhaust duct 120, fan 116, as well as the inside surfaces of the body walls. Any suitable sound-dampening material may be applied to such surfaces.

Figure 7A:
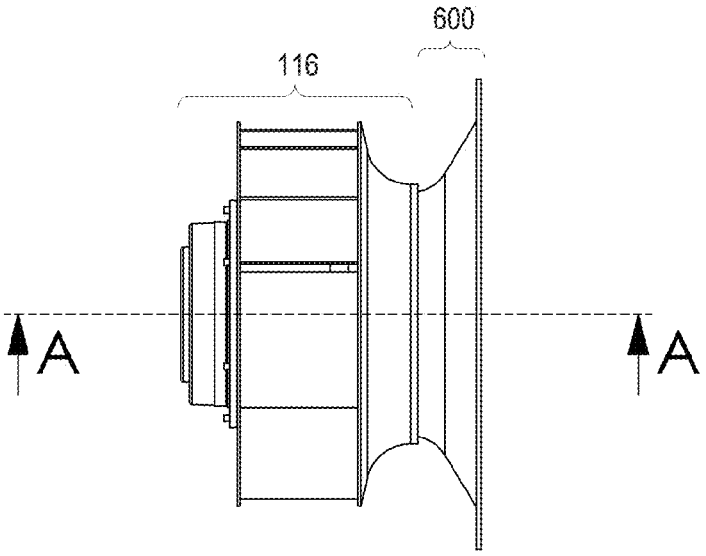
FIG. 7A and FIG. 7B show an example tapered channel structure that extends between an electrostatic precipitation system and fan of an example cooking system.
Figure 7B:
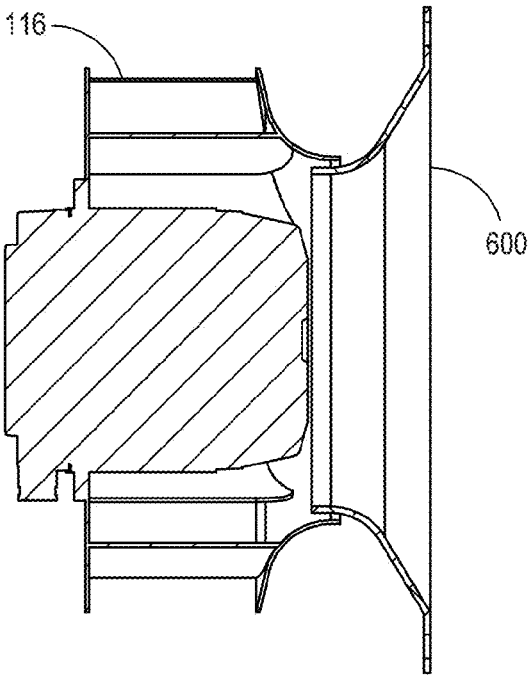

As mentioned above, various structures within the ventilation system of cooking system 102 may on occasion be subject to low frequency pressure oscillations, which may be audible. As such, continuing with FIG. 6, the tapered channel structure 600 may be formed in a way that helps to avoid such oscillations. FIG. 7A shows a side view of an example of the tapered channel structure 600 attached to the fan 116, and FIG. 7B shows a cross-sectional view representing section A-A illustrating these components. FIG. 7B shows the fan 116 attached to the tapered channel structure 600, such that a portion of the tapered channel structure 600 is surrounded by and/or inserted into a body of the fan 116. It is noted that the inserted portion of the tapered channel structure 600 terminates without a flared end (e.g. the radius of the tapered channel does not increase at the end of the taper in a direction from the electrostatic particulate system to the fan). Any suitable length of the tapered channel structure 600 may be inserted into the body fan 116. As a non-limiting example, a length of more than ⅛ inch may be inserted into the body of the fan. Further, the tapered channel structure 600 is illustrated as having a relatively smooth curve. The use of such a shape for the tapered channel structure 600 may help to reduce the occurrence of low frequency noise compared to a tapered channel structure of a different shape, e.g. where the inserted portion has a flared configuration, and/or where the taper is discontinuous and/or segmented.

The fan may take any suitable form. For example, the fan 116 may take the form of a blower wheel fan. The use of a rigid blower wheel, such as a metal or composite blower wheel, may offer advantages over the use of a less rigid blower wheel, such as a blower wheel made from a flexible plastic, as a less rigid blower wheel may cause noticeable vibration in the cooking system, whereas a more rigid blower wheel may avoid such vibrations. Likewise, in some examples, the tapered channel structure 600 may be formed at least partially from a less rigid material, e.g. a plastic material, while in other examples, the tapered channel structure 600 may be formed at least partially from a rigid material.

Figure 8:
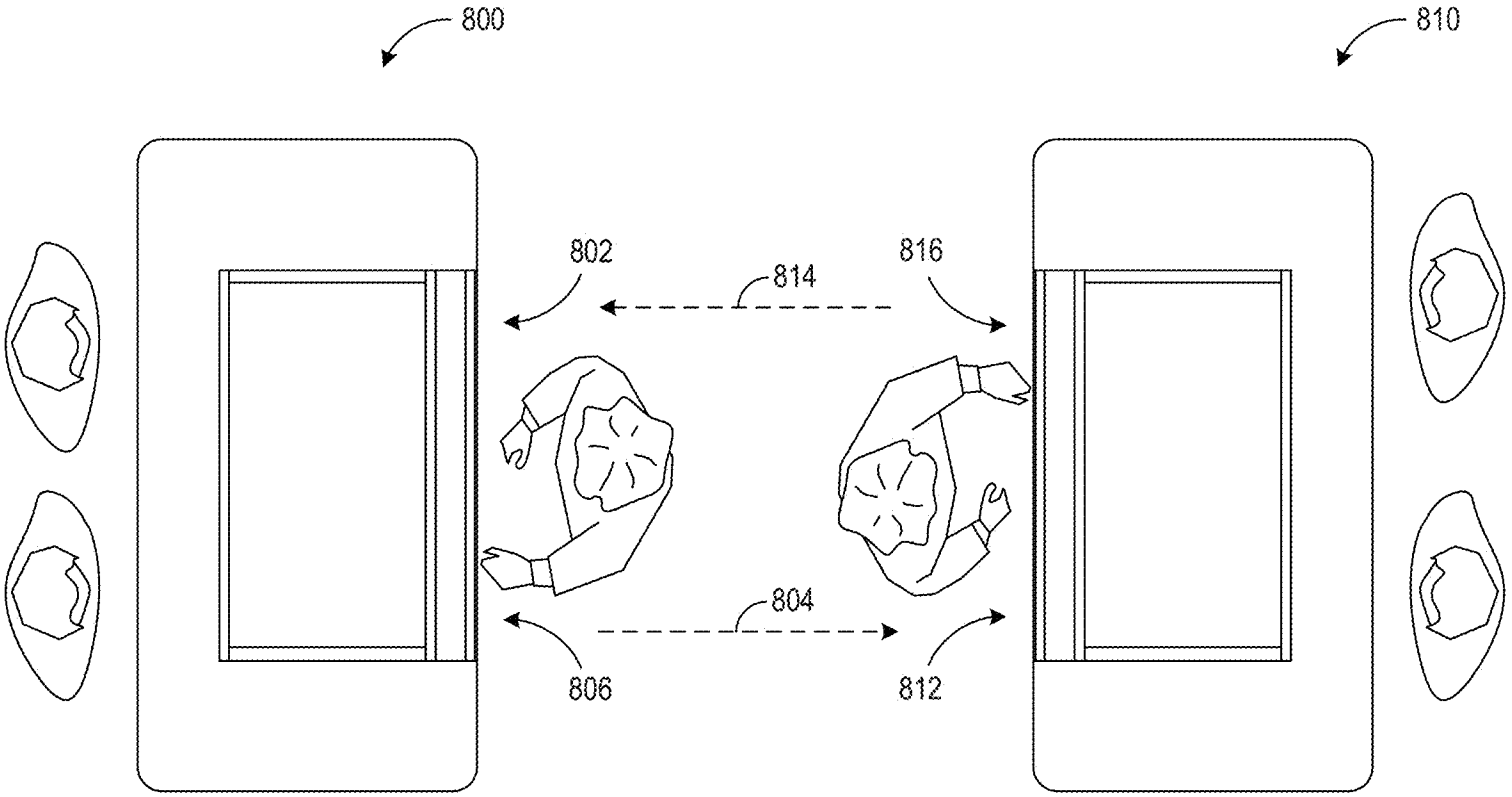
FIG. 8 shows two example cooking systems in an example arrangement.

FIG. 8 shows a plan view of an example arrangement of two cooking systems 800 and 810. Restaurants may arrange cooking systems in this manner to maintain a separation of customer space and staff space. However, exhaust exiting out of the backside of one cooking system may impinge on the backside of the other cooking system, resulting in noise. Thus, as mentioned above, the cooking systems 800, 810 may include noise reduction screens 802, 812 positioned to mitigate impingement noise arising from exhaust of adjacent cooking systems. As mentioned in FIG. 1, a noise reduction screen 128 is positioned on the backside 110 of the body 102 of the cooking system 100 at a location laterally spaced from an outlet 130 of the muffler 122. As shown in FIG. 8, exhaust 804 exiting from muffler outlet 806 of the cooking system 800 is directed towards the noise reduction screen 812 of neighboring cooking system 810. Likewise, exhaust 814 exiting from muffler outlet 816 of the cooking system 810 is directed towards the noise reduction screen 802 of the cooking system 800. As such, each of the noise reduction screens 802, 812 may reduce potential noise resulting from exhaust impinging on the backside of the other cooking system.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and nonobvious combinations and subcombinations of the various processes, systems and configurations, and other features, functions, acts, and/or properties disclosed herein, as well as any and all equivalents thereof.

The invention claimed is:

1. A cooking system, comprising:

a body supporting a cooking surface;

an air duct located within the body;

an air inlet disposed adjacent the cooking surface and in fluid communication with the air duct;

a fan disposed within the body, the fan being configured to pull exhaust from cooking through the air inlet and the air duct;

a muffler disposed within the body and configured to receive the exhaust from the fan;

an exhaust duct disposed within the body and connecting the fan to the muffler to carry the exhaust from the fan to the muffler, the exhaust duct having a curved configuration between an outlet of the fan and an inlet of the muffler; and wherein the muffler is positioned to exhaust the exhaust received from the fan out of a backside of the body of the cooking system.

2. The cooking system of claim 1, wherein the fan is configured to direct exhaust exiting the fan toward a front side of the body of the cooking system, and wherein the exhaust duct is configured to redirect the exhaust toward the backside of the body.

3. The cooking system of claim 1, wherein the exhaust duct comprises a 180-degree turn between the outlet of the fan and the inlet of the muffler.

4. The cooking system of claim 1, further comprising a noise reduction screen on the backside of the body laterally spaced from an outlet of the muffler.

5. The cooking system of claim 1, further comprising a filtration assembly disposed fluidically between the air duct and the fan, and a sound-absorbing material disposed on one or more of the filtration assembly, the air duct, the exhaust duct, and the fan.

6. The cooking system of claim 5, further comprising a tapered channel connecting the filtration assembly to the fan.

7. The cooking system of claim 6, wherein the tapered channel is at least partially formed from a plastic material, and wherein the fan comprises a metal blower wheel.

8. A cooking system, comprising:

a body supporting a cooking surface;

an air duct located within the body;

an air inlet disposed adjacent the cooking surface and in fluid communication with the air duct;

a fan disposed within the body, the fan being configured to pull exhaust from cooking through the air inlet and the air duct;

a muffler disposed within the body and configured to receive the exhaust from the fan;

an exhaust duct disposed within the body and connecting the fan to the muffler to carry the exhaust from the fan to the muffler, wherein the fan is configured to direct exhaust exiting the fan toward a front side of the body of the cooking system, and wherein the exhaust duct is configured to redirect the exhaust toward a backside of the body; and wherein the muffler is positioned to exhaust the exhaust received from the fan out of a backside of the body of the cooking system.

9. The cooking system of claim 8, further comprising a noise reduction screen on the backside of the body laterally spaced from an outlet of the muffler.

10. The cooking system of claim 8, further comprising a filtration assembly disposed fluidically between the air duct and the fan, and a sound-absorbing material disposed on one or more of the filtration assembly, the air duct, the exhaust duct, and the fan.

11. The cooking system of claim 10, further comprising a tapered channel connecting the filtration assembly to the fan.

12. The cooking system of claim 11, wherein the tapered channel is at least partially formed from a plastic material, and wherein the fan comprises a metal blower wheel.

* * * * *